United States Patent [19]

Chen

[11] 4,319,163

[45] Mar. 9, 1982

[54] ELECTRON GUN WITH DEFLECTION-SYNCHRONIZED ASTIGMATIC SCREEN GRID MEANS

[75] Inventor: Hsing-Yao Chen, Landisville, Pa.

[73] Assignee: RCA Corporation, New York, N.Y.

[21] Appl. No.: 164,685

[22] Filed: Jun. 30, 1980

[51] Int. Cl.[3] ..... H01J 29/46; H01J 29/56

[52] U.S. Cl. ..... 315/14; 313/414

[58] Field of Search ..... 315/14, 368, 370, 371, 315/382; 313/412, 414, 449

[56] References Cited

U.S. PATENT DOCUMENTS

| | | | |
|---|---|---|---|
| 2,884,559 | 4/1959 | Cooper, Jr. et al. . | |
| 2,901,661 | 8/1959 | Neuhauser | 315/382 |
| 3,919,583 | 11/1975 | Hasker et al. | 313/414 |
| 4,143,293 | 3/1979 | Hosokoshi et al. | 313/414 |
| 4,242,613 | 12/1980 | Brambring et al. | 313/448 |

OTHER PUBLICATIONS

"Focusing on the New Panasonic 'Quintrix' Color TV Picture Tube" by David H. Carpenter, pp. 52 & 53 of Audio Video, Feb. 1974.

*Primary Examiner*—Theodore M. Blum

*Attorney, Agent, or Firm*—Eugene M. Whitacre; Glenn H. Bruestle; Dennis H. Irlbeck

[57] ABSTRACT

An electron gun comprises an astigmatic beam forming means including a cathode, a control grid, a first screen grid electrode having a horizontally elongated rectangular aperture, and a second screen grid electrode having a circular aperture. In operation, the second screen grid is energized with a DC bias voltage and the control grid and first screen grid is energized with a DC bias superposed with a substantially parabolically shaped dynamic signal synchronized with either or both the horizontal and vertical deflection signals. Thus, the astigmatic optics of the beam forming means varies in strength in phase with the beam scan so as to provide optimum correction for flare distortion of the electron beam.

8 Claims, 6 Drawing Figures

ELECTRON GUN WITH DEFLECTION-SYNCHRONIZED ASTIGMATIC SCREEN GRID MEANS

This invention relates to cathode ray tubes, and particularly to color picture tubes of the type useful in home television receivers, and to electron guns therefor. The invention is especially applicable to self-converging tube-yoke combinations with shadow mask tubes of the type having plural-beam in-line guns disposed in a horizontal plane, an apertured mask with vertically oriented slit-shaped apertures, and a screen with vertically oriented phsophor stripes. The invention is not, however, limited to use in such tubes and may in fact be used, e.g., in dot-type shadow mask tubes and index-type tubes.

An in-line electron gun is one designed to generate at least two, and preferably three, electron beams in a common plane and to direct the beams along convergent paths to a small area spot on the screen. A self-converging yoke is one designed with specific field nonuniformities which automatically maintain the beams converged throughout the raster scan without the need for convergence means other than the yoke itself.

BACKGROUND OF THE INVENTION

There has been a general trend toward in-line color picture tubes with greater deflection angles in order to provide shorter tubes. In a tube with 110° deflection, it has been found that the electron beams become excessively distorted as they are scanned toward the outer portions of the screen. Such distortions are commonly referred to as flare and appear on the screen of the tube as an undesirable low intensity tail or smear extending from a desirable intense core or spot. Such flare distortions are due, at least in part, to the effects of the fringe portions of the deflection field of the yoke on the beam as it passes through the electron gun, and to the nonuniformities in the yoke deflection field itself.

When the yoke's fringe field extends into the region of the electron gun, as is usually the case, the beams may be deflected slightly off axis and into a more aberrated portion of an electron lens of the gun. The result is frequently a flare distortion of the electron beam spot which extends from the spot toward the center of the screen. This condition is particularly troublesome in self-converging yokes having a toroidal deflection coil, because of the relatively strong fringing of toroidal type coils.

Self-converging yokes are designed to have a nonuniform field in order to increasingly diverge the beams as the horizontal deflection angle increases. This nonuniformity also causes vertical convergence of the electrons within each individual beam. Thus, the beam spots are vertically overconverged at points horizontally displaced from the center of the screen, causing a vertically extending flare both above and below the beam spot.

The vertical flare due to both the effects of the yoke's fringe field in the region of the gun and to the nonuniform character of the yoke field itself is an undesirable condition which contributes to poor resolution of a displayed image on the screen.

It is known to provide non-symmetrical electron gun electrodes to in turn provide a desired astigmatism in the electron optics of the gun for the purpose of compensating for the above-described flare astigmatism. An example of this is disclosed in U.S. Pat. No. 4,234,814 issued to Chen and Hughes on Nov. 18, 1980. This Patent describes a screen grid electrode having an aperture which is of rectangular cross-section facing backward toward the cathode and circular cross-section facing forward toward the screen. This astigmatic screen grid is of one piece, electrically speaking, and is energized during tube operation with a fixed DC bias voltage. While this gun does indeed reduce flare astigmatism to a degree sufficient for some tubes, still further correction is desirable for other tubes, particularly very wide angle deflection tubes and particularly where they are to be used to display printed matter near the corners of the screen.

SUMMARY OF THE INVENTION

An electron gun comprises an astigmatic beam forming region including a cathode, a control grid and a screen grid means. The screen grid means comprises a first apertured plate whose aperture is elongated (preferably in the horizontal direction) and a second apertured plate adjacent to the first plate whose aperture is circular. In operation of the electron gun, the second plate is energized with a DC bias voltage and the first plate is energized with a DC bias voltage superposed with a dynamic signal synchronized with either or both the horizontal and vertical deflection signals. Thus, the astigmatic optics of the beam forming means varies in strength in phase with the beam scan so as to provide the greatest correction for flare where the greatest correction is needed, viz, at the corners of the scanned raster.

DETAILED DESCRIPTION OF THE PREFERRED EMBODIMENT

Figure 1:
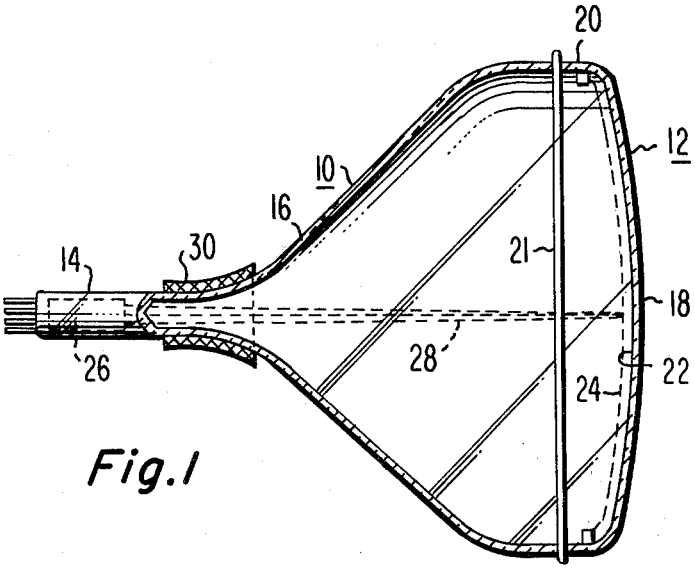
FIG. 1 is a schematic plan view of a cathode ray tube embodying the novel electron gun.

FIG. 1 illustrates a rectangular color picture tube 10 having a glass envelope comprising a rectangular faceplate panel 12 and a tubular neck 14 connected by a rectangular funnel 16. The panel 12 comprises a viewing faceplate 18 and a peripheral side wall 20 which is joined to the funnel 16 with a frit seal 21. A mosaic three-color phosphor screen 22 is disposed on the inner surface of the faceplate 18. The screen is preferably a line screen with the phosphor lines extending perpendicular to the intended direction of high frequency scanning. A multiapertured slit-type color selection shadow mask electrode 24 is removably mounted by conventional means in predetermined spaced relation to the screen 22. A novel in-line electron gun 26, shown schematically by dotted lines, is centrally mounted within the neck 14 to generate and direct three electron beams 28 along coplanar convergent paths through the mask 24 to the screen 22.

The tube of FIG. 1 is designed to be used with an external magnetic deflection yoke 30 disposed around the neck 14 and funnel 12 in the neighborhood of their junction, for scanning the three electron beams 28 horizontally and vertically in a rectangular raster over the screen 22. The yoke is preferably self-converging.

Except for the novel modifications as hereinafter described, the electron gun 26 may be of the 3-beam in-line type similar to those described in copending U.S. application of Hughes and Chen, Ser. No. 078,134 filed Sept. 24, 1979, which discloses a thick screen grid, and U.S. Pat. No. 4,234,814, which discloses a slotted screen grid. Both of these applications disclose modified versions of the electron gun described in U.S. Pat. No. 3,772,554, issued to Hughes on Nov. 13, 1973. This copending application and the two patents are incorporated by reference herein for the purpose of disclosure.

Figure 2:
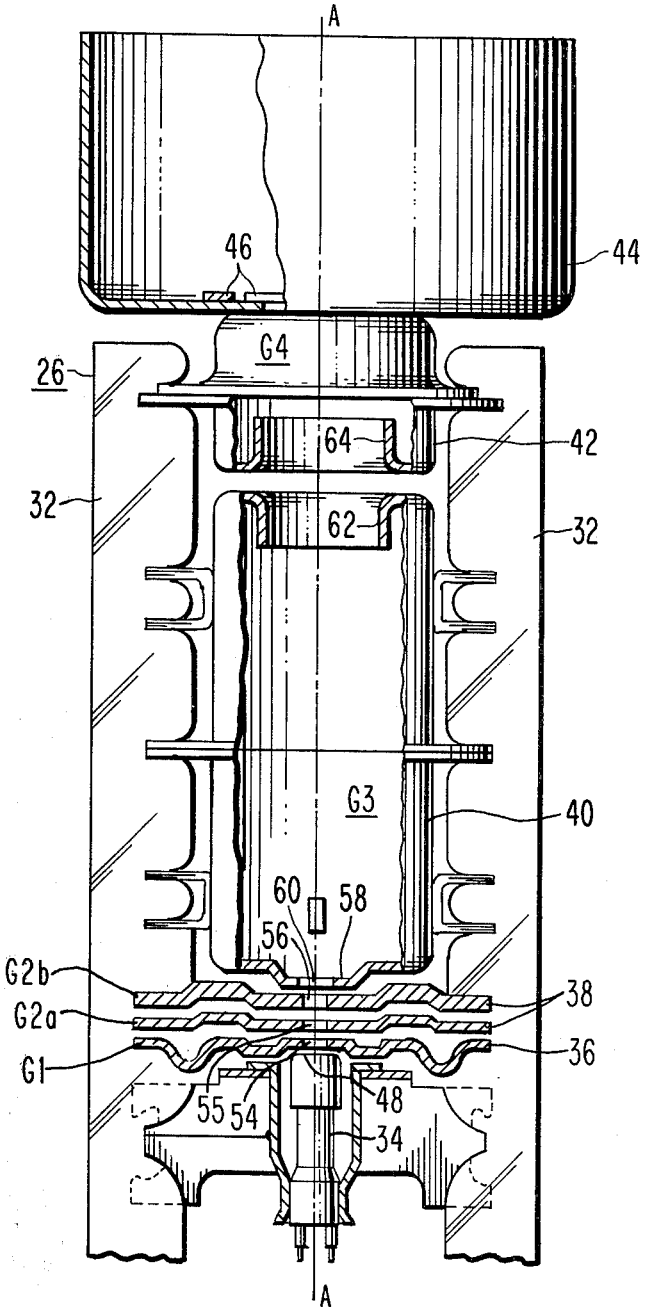
FIG. 2 is a longitudinal elevation, partly in section, of one embodiment of the novel electron gun of FIG. 1.

FIG. 2 is an elevation in partial central longitudinal section of the 3-beam electron gun 26, in a plane perpendicular to the plane of the coplanar beams of the three guns. As such, structure pertaining to but a single one of the three beams is illustrated in the drawing. The electron gun 26 is of the bipotential type and comprises two glass support rods 32 on which the various electrodes are mounted. These electrodes include three equally spaced coplanar cathodes (k) 34 (one for each beam, only one of which is shown), a control grid (G1) electrode 36, a screen grid means 38 comprising a first electrode plate G2*a* and a second electrode plate G2*b*, a first lens or focusing (G3) electrode 40, and a second lens or focusing (G4) electrode 42. The G4 electrode includes an electrical shield cup 44. All of these electrodes are aligned on a central beam axis A—A and mounted in spaced relation along the glass rods 32 in the order named. The focusing electrodes G3 and G4 also serve as accelerating electrodes in the bipotential gun 26.

Also shown in the electron gun 26 are a plurality of magnetic members 46 mounted on the floor of the shield cup 44 for the purpose of coma correction of the raster produced by the electron beams as they are scanned over the screen 22. The coma correction magnetic members 46 may, for example, be as those described in the above-referenced U.S. Pat. No. 3,772,554.

The tubular cathode 34 of the electron gun 26 includes a planar emitting surface 48 on an end wall thereof. The G1, G2*a* and G2*b* electrodes comprise transverse plates which have aligned apertures 54, 55 and 56, respectively, therein. The G3 comprises an elongated tubular member having a transverse wall 58 adjacent to the G2*b*, which has an aperture 60 therein. The G4, like the G3, comprises a tubular member; and these two electrodes, at their facing ends, have inturned tubular lips 62 and 64 between which the main focusing lens of the electron gun is established.

Figure 4:
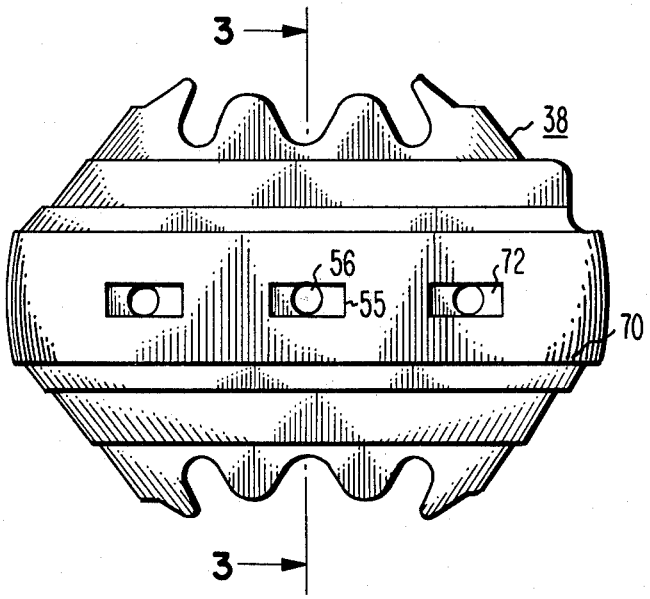
FIG. 4 is an elevation, taken along line 4—4 of FIG. 3, of the novel screen grid electrode means of the novel gun.
Figure 3:
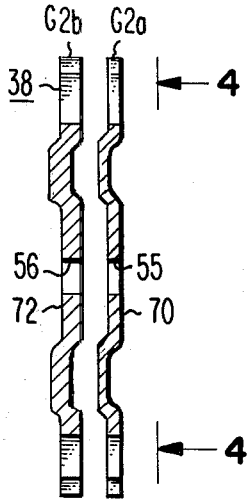
FIG. 3 is an enlarged section of the screen grid electrode means of FIG. 2 taken along line 3—3 of FIG. 4.

FIGS. 3 and 4 illustrate in detail the screen grid means 38 of the electron gun 26. Both of the screen grid electrodes G2*a* and G2*b* comprise plate-like members having central planar apertured portions 70 and 72, respectively. The G2*a* electrode plate has three apertures 55 elongated in the form of rectangles, the major cross-sectional axis of which are coincident and in the horizontal direction. The G2*b* electrode plate has three circular apertures 56 aligned horizontally. Each of the three apertures of the G2*a* electrode is aligned along a beam path with, and overlies, one of the three apertures 56 of the G2*b* electrode.

The G2*b* screen grid electrode plate may be of a thick G2 design substantially as shown and described in the copending application of Hughes and Chen, Ser. No. 078,134.

When the G2*a* and G2*b* are at the same potential, the electron optics of the beam forming electrodes of the electron gun 26 are basically similar to those of the slotted G2 electron gun disclosed in U.S. Pat. No. 4,234,814. Electrons are emitted from the cathode 34 and are converged toward a cross-over by a rotationally symmetric electric field which dips into the circular G1 aperture toward the cathode. An astigmatic electric field is established at the beam entrance side of the G2*a* electrode plate aperture 55. This field acts differently on the convergent electron rays in a horizontal plane than it does on the convergent electron rays in a vertical plane. In a horizontal plane the electron rays undergo a slight straightening so as to provide a relatively narrow angle cross-over. In the vertical plane the electron rays undergo a greater straightening and, therefore, converge with an even shallower cross-over angle to a cross-over farther forward than the horizontal rays.

In operation of the slot G2 electron gun disclosed in U.S. Pat. No. 4,234,814, the operational voltages were adjusted to produce an electron beam in which the rays in the vertical plane were underconverged. This allowed for compensation of the vertical overconvergence inherent in the deflection yoke field. But in order to take fullest advantage of this compensation, it was necessary to accept a vertically elongated spot in the center of the screen. The tolerable vertical elongation at the center of the screen was a limitation upon the amount of correction or compensation that could be obtained at the edge of the screen.

With the present novel electron gun 26, compromise between the center and edge of the screen, as described above, is no longer necessary. Since the screen grid means is provided as two electrically separate electrodes, the degree of astigmatism in the beam forming regions can be dynamically controlled in synchronism with the scanning of the electron beams. Thus, instead of operating the G2*a* and G2*b* electrodes at the same potential, the voltage difference between these electrodes can be modulated as the electron beam is scanned from the center of the screen to the edge of the screen.

Specifically, in an electron gun embodiment such as that shown in FIGS. 2, 3 and 4 wherein the G2*a* apertures are horizontally elongated, an increasing degree of astigmatism is provided by a decreasing voltage on the G2*a*. Furthermore, the G2*a* and G2*b* can be biased so that when the electron beam is at the center of the screen, the G2*a* will be slightly positive relative to the G2*b*, thus eliminating the vertical underconvergence which had to be accepted in prior art single G2 slot electrodes. Thus, essentially perfect focus, both horizontaly and vertically, of the electron beam over the entire screen is obtained.

Figure 5:
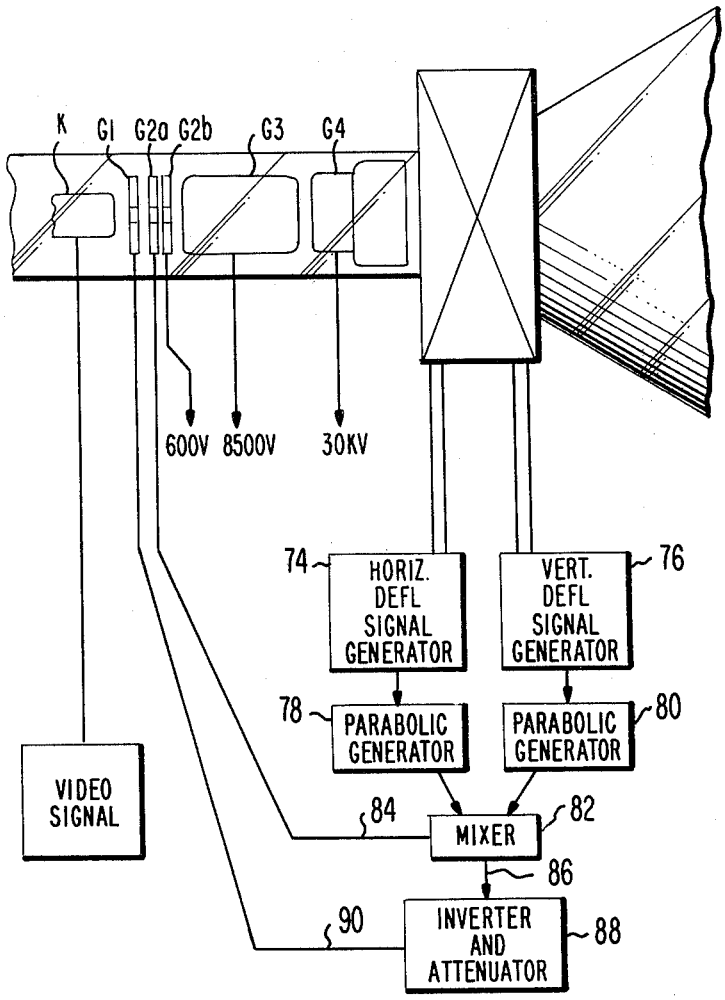
FIG. 5 is a schematic illustration of one suitable system for operating the novel electron gun of FIG. 2.

FIG. 5 schematically illustrates one way this dynamic correction may be accomplished. In conventional manner, vertical deflection signals and horizontal deflection signals are fed to the yoke 30 to provide the vertical and horizontal scan so as to create a raster on the screen. In conventional manner also, fixed DC bias voltages may be applied as follows: 600 volts on the circularly apertured screen grid plate G2*b*, 8500 volts on the focus electrode G3, and 30,000 volts on the accelerating electrode G4. The horizontal and vertical deflection signals from horizontal and vertical signal generators 74 and 76 are fed to separate signal processors 78 and 80 which generate parabolic signals synchronized respectively with the horizontal and vertical deflection signals. These parabolic signals are then fed to a mixer 82. One output 84 of the mixer feeds the mixed signal directly to the G2*a* and another output 86 feeds the mixed signal to a phase inverter and attenuator 88 whose output 90 is fed to the G1. Thus, the voltage on these two electrodes is dynamically varied in phase with the voltage applied to both the horizontal and vertical deflection coils of yoke 30.

Alternatively, the G1 can be held at a fixed DC bias voltage and a parabolically processed deflection signal applied only to the G2*a*. However, in this case a varying potential difference will be developed between the G1 and the G2*a*, resulting in a slight dynamic variation in the cut-off characteristics of the electron gun. If the dynamic correction being applied to the screen grid electrode G2*a* is sufficiently small in amplitude, this variation may not too seriously affect the operation of the tube. In such case the inverter and attenuator 88 is simply omitted and the G1 grounded.

Also, alternatively, the dynamic scan synchronization correction can be related to only one of the horizontal or vertical scan signals. This can be done with either the horizontal or vertical signal, but would usually be with the horizontal signal since flare distortion of the beam varies most with the horizontal scan. In such case, the vertical parabolic generator 80 and mixer 82 are omitted and the output from the horizontal parabolic generator is fed directly into the phase inverter and attenuator 88.

In an arrangement such as shown in FIG. 5 wherein the G2*b*, G3 and G4 electrodes are energized as shown, the horizontal parabolic generator 78 produces a parabolic signal which varies from about +650 volts when the beam is at the center of the screen to about +400 volts when the beam is at the extreme right or left edge of the screen. The parabolic signal is phased with the deflection so that its apex occurs when the beam is at the center of the screen. At the same time the vertical parabolic generator 80 produces a parabolic signal which varies from about +650 volts when the beam is at the center of the screen to about +525 volts when the beam is at the extreme upper or lower edge of the screen. The vertical parabolic signal is phased with the vertical beam deflection so that its apex also occurs when the beam is at the center of the screen.

When the two outputs from the horizontal and vertical parabolic generators are combined in the mixer 82, a composite signal is produced in which a series of excursions according to the horizontal parabolic signal rides on the much lower frequency and lower amplitude vertical parabolic signal. This composite signal is fed directly to the G2*a* and to the phase inverter and attenuator 88. With the electron gun 26 having dimensions hereinafter set forth, cutoff is maintained when voltage variations on the G1 and G2*a* are maintained in a 1:5 ratio and in opposite polarity, i.e., 180° out of phase with each other. These adjustments to the mixer output are made by the phase inverter and attenuator 88 for application to the G1. For example, if the G2*a* and G2*b* are electrically connected together, a cutoff voltage of +150 volts (on the cathode) results with the G2*b* biased at +600 volts and the G1 biased at 0 volts. Thus, to maintain this cutoff characteristic, when the G2*a* is driven to +650 volts (i.e., 50 volts have the G2*b* bias) the G1 must be driven negatively one-fifth of this or to −10 volts. Similarly when the G2*a* is driven to +400 volts (i.e., 200 volts below the G2*b* bias) the G1 must be driven positively to +40 volts.

Figure 6:
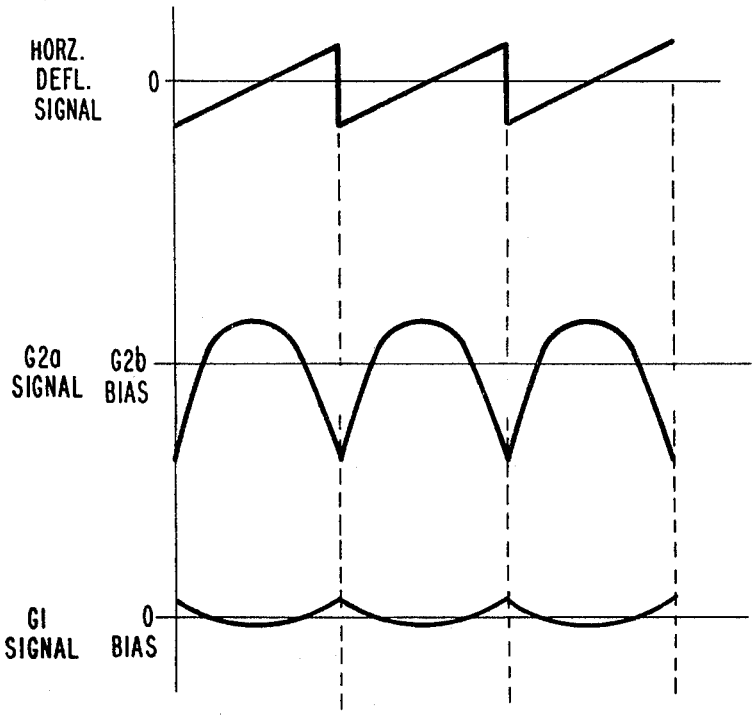
FIG. 6 is a schematic illustrating typical waveforms of signals used in operation of the novel electron gun.

FIG. 6 illustrates the relationship between the horizontal deflection signal and the processed parabolic signals applied to the G2*a* and G1 during a series of horizontal scans when the vertical scan is near the center of the screen. The horizontal deflection signal is a conventional sawtooth and varies from some negative value through zero when the beam is at the center of the screen with zero deflection to some positive value. The G2*a* signal varies at its apex from a positive value slightly above the G2*b* bias when the beam is undeflected at the center of the screen and decreases to a minimum when the beam is deflected to the left or right edge of the screen. The G1 signal is of similar shape but inverted, and of lesser magnitude. It varies at its apex from a minimum to a maximum when the beam is deflected to left or right of the screen.

The relative amplitudes of the outputs from the horizontal and vertical parabolic generators 78 and 80 should be proportional to the corrections needed as horizontal and vertical deflection increases. These needed corrections are not normally equal. The correction needed as horizontal deflection increases is primarily due to an increasing underconvergence characteristic of the deflection yoke. This characteristic is invariant with vertical deflection. The correction needed as vertical deflection increases is primarily due to an increasing amount of deflection coma distortion in the main focus lens of the electron gun. These corrections (horizontal and vertical) will vary with the particular design of yoke and gun used. A typical relationship of the relative magnitudes of horizontal and vertical correction needed for equal given deflections in the horizontal and vertical directions might be in a range of ratios of about 2:1 to 3:1. Thus, with the horizontal correction signal from the generator 78 varying 250 volts (from +650 to +400 volts), the vertical correction signal from the generator 80 should vary about 85 to 125 volts, e.g., from +650 to +525 volts. Thus, the G2*a* and G1 instantaneous biases might typically be as shown in the following table:

| G1 Bias | G2a Bias | Beam Position |
|---|---|---|
| −10 v. | +650 v. | center of raster |
| +40 v. | +400 v. | end of horizontal axis |
| +15 v. | +525 v. | end of vertical axis |
| +65 v. | +275 v. | corner of raster |

The signals applied to the G1 and G2*a* may be described as parabolic. However, some shaping from true parabolism may be necessary according to known techniques to accommodate variations in the electron beam optics of the electron gun or the yoke.

In one embodiment of the novel gun 26 the following dimensions were used:

| | |
|---|---|
| G1 aperture diameter | 0.635 mm |
| G2b aperture diameter | 0.635 mm |
| G3 aperture diameter | 1.524 mm |
| G2a aperture dimensions | 0.711 × 2.133 mm |
| G1 thickness | 0.127 mm |
| G2a thickness | 0.203 mm |
| G2b thickness | 0.508 mm |
| G3 thickness | 0.254 mm |
| G1–G2a spacing | 0.127 mm |
| G2a–G2b spacing | 0.076 mm |

-continued

| | |
|---|---|
| G2b–G3 spacing | 0.838 mm |

The invention has been described above as involving rectangularly shaped apertures in the G2*a* screen grid electrode, which are oriented with their elongated dimension in the horizontal direction, however, these elongated apertures may be disposed vertically. In this case instead of modulating the screeen grid G2*a* electrode with a horizontal correction signal voltage varying from +650 volts at the center of the screen, to +400 volts at the edges of the screen, a positive going signal will be applied to the G2*a* electrodes such that the voltage thereon will be varied from about +550 volts at the center of the screen to about +800 volts along the major axis at the edge of the screen. Corresponding adjustments are made in the vertical correction signal and hence in the signal applied to the G1 in accordance with teachings hereinbefore set forth.

GENERAL DESIGN CONSIDERATIONS

The beam forming apertures 56 of the G2*b* is preferably circular in cross-section, although other cross-sectional shapes can be employed. Circularity of the aperture is preferred because a circular beam spot on the screen is ideally desired. Accordingly, it is desirable to introduce a limited amount of astigmatism into the beam forming region so that the undesirable flare of the beam spot can be eliminated without distorting the shape of the main intense core of the beam spot from its otherwise desired circular symmetry. If the beam forming apertures 56 is made noncircular it can have the undesirable effect of distorting the beam spot core away from circular symmetry.

The horizontal length of the slot aperture 55 in the G2*a* is not critical as long as it is great enough to exert no significant effect on the horizontally converging rays of the electron beam. It has been found that a length of at least five times as great as the thickness of the G2*a* will result in the desirable absence of any adverse effect on the electron rays of the beam.

In order to obtain the desired astigmatic effect in the beam forming region, the width of the slot aperture 55 in the vertical plane should be from 2 to 5 times the thickness of the G2*a* plate. Furthermore, the thickness of the G2*a* should not exceed the diameter of the beam forming aperture 56 in the G2*b*, otherwise the divergence effects of the field in the G2*a* are so great as to adversely affect the desirable crossover optics of the beam forming region in a manner inconsistent with the use of a thick G2*b*. It has been found that when the thickness of the G2*a* is increased much beyond 0.8 times the diameter of the aperture 56 the quality of the beam forming optics degenerates rapidly. For a gun with an aperture 56 of 0.635 mm diameter, the G2*a* is preferably not thicker than 0.508 mm.

Conversely, the thickness of the G2*a* should not be so small as to require a slot width significantly less than the diameter of the G2*b* aperture 56. Although the width of the slot aperture 55 can be less than the diameter of the beam forming aperture 56, when it is made excessively less, the mechanical tolerance of the alignment between the slot aperture 55 and the beam forming aperture 56 becomes critical. Experience has shown that with a beam forming aperture 56 of 0.635 mm diameter, the G2*a* can be made as little as 0.076 mm thick. However, if the thickness is made much less than about 0.152 mm, the width of the slot aperture 55 must be sufficiently toward the high end of the slot width/thickness ratio range of 2–5 that an optimum slot width cannot be utilized. It is, therefore, preferred that the thickness of the G2*a* be 0.24–0.8 times the diameter of the electron beam aperture 56.

It has also been found that in a thick G2*b* gun, the total thickness of the G2*a* and G2*b* should not exceed about 1.2 times the diameter of the G2*b* beam forming aperture 56. Thus, for a G2*b* 0.508 mm thick, when the G2*a* is increased beyond 0.254 mm, the G2*b* should be correspondingly decreased below 0.508 mm, otherwise the beam forming optics are severely distorted. The thickness of the G2*b* should be 0.4–1.0 times the diameter of the electron beam aperture 56.

The magnitude of astigmatic correction needed in any given tube is a function of the distortion produced as a result of the nonuniform yoke field and the electron optics of the tube itself. The magnitude of the astigmatic correction signal on the G2*a*, i.e., the instantaneous bias which must be applied to the G2*a* to obtain a given needed correction is a function of the strength of the astigmatism-producing slot lens in the G2*a*. The strength of this lens can be increased by: (a) decreasing the width of the slot aperture 55, (b) increasing the thickness of the slotted plate 70, (c) decreasing the G1–G2*a* spacing, and/or (d) decreasing the G2*a*–G2*b* spacing.

I claim:

1. In a cathode ray tube, a cathodoluminescent screen and an electron gun comprising beam forming means and beam focusing means for projecting a electron beam onto said screen, said beam forming means comprising a cathode, a control grid, and first and second screen grid electrodes for generating electrons and forming them into a beam having a first cross-over in the vicinity of said screen grid electrodes; said first electrode being adjacent to said control grid and having an elongated astigmatic field-forming aperture therein, and said second electrode being closely adjacent to said first electrode on the side thereof opposite said control grid and having a circular aperture therein;

said beam focusing means comprising at least two apertured electrodes for establishing a main focus lens for focusing said electron beam so as to image said first cross-over on said screen; and first means applying to said first screen grid electrode a substantially parabolic shaped signal which is synchronized with a horizontal beam-scanning signal, and second means applying a fixed DC operating voltage to said second screen grid electrode.

2. An electron gun comprising separate beam forming means and beam focusing means;

said beam forming means comprising a cathode, a control grid, a first screen grid electrode having a rectangular aperture therein, and a second screen grid electrode having a circular aperture therein, said first and second screen grid electrodes being substantially flat plates parallel to each other.

3. In a cathode ray tube a cathodoluminescent screen and an electron gun for projecting an electron beam onto said screen, said tube being adapted to have said beam modulated with a video signal and scanned horizontally and vertically to display an image on said screen, said electron gun comprising beam forming means and beam focusing means;

said beam forming means comprising, in the order named, a cathode, a control grid, and a screen grid means for generating electrons and forming them into a beam having a first cross-over in the vicinity of said screen grid means;

said beam focusing means comprising at least two apertured electrodes for establishing a main focus lens for focusing said electron beam so as to image said first cross-over on said screen;

said screen grid means comprising a first plate member having an aperture therein whose cross-sectional shape is elongated in the direction of said horizontal scan and a second plate member closely adjacent to said first plate member on the side thereof opposite said control grid and having a circular aperture therein, said first and second plate members being spaced from and electrically insulated from each other, and terminal means for separately applying a fixed DC operating voltage to said second plate member and dynamic signal voltages to said first plate member, said signal voltages being synchronized with at least one of the deflection signals utilized for producing said horizontal and vertical scan of said electron beam.

4. An electron gun comprising beam forming means and beam focusing means, said gun being adapted to be operated in a particular rotational orientation about a longitudinal axis thereof relative to deflection means for scanning an electron beam of said gun in horizontal and vertical directions;

said beam forming means comprising a cathode, a control grid, a first screen grid member, and a second screen grid member, said first screen grid member having an elongated slot-shaped aperture therein and said second screen grid member having a circular aperture therein, means connecting said second screeen grid member to a source of DC bias voltage, and means connecting said control grid and said first screen grid member through signal processing circuits to a signal source utilized for deflecting said electron beam in said horizontal scan direction.

5. A cathode ray tube system comprising a cathodoluminescent screen, an electron gun for projecting an electron beam onto said screen, magnetic field-forming yoke means for scanning said beam horizontally and vertically over said screen to produce a raster thereon, and power supply means for energizing said screen, gun and yoke;

said electron gun comprising in the order named a cathode, a control grid electrode, first and second screen grid electrodes, and first and second lens electrodes between which a main beam focusing lens field is established;

said first screen grid electrode having an aperture therein whose cross-sectional shape is elongated in the direction of said horizontal scan, and said second screen grid electrode having a circular aperture therein, said power supply means comprising:

(a) horizontal and vertical deflection signal generators for supplying appropriate scanning signals to said yoke, (b) signal processing means connected to one of said deflection signal generators for producing an astigmatism correction signal synchronized with the scan signal from said one of said deflection signal generators, and (c) means coupling said astigmatism correction signal to said first screen grid electrode.

6. The system of claim 5 wherein said signal processing means comprises a parabolic signal generator.

7. A cathode ray tube system comprising a cathodoluminescent screen, an electron gun for projecting an electron beam onto said screen, magnetic field-forming yoke means for scanning said beam horizontally and vertically over said screen to produce a raster thereon, and power supply means for energizing said screen, gun and yoke;

said electron gun comprising in the order named a cathode, a control grid electrode, first and second screen grid electrodes, and first and second lens electrodes between which a main beam focusing lens field is established;

said first screen grid electrode having an aperture therein whose cross-sectional shape is elongated in the direction of said horizontal scan, and said second screen grid electrode having a circular aperture therein, said power supply means comprising:

(a) horizontal and vertical deflection signal generators for supplying appropriate scanning signals to said yoke, (b) signal processing means connected to one of said deflection signal generators for producing an astigmatism correction signal synchronized with the scan signal from said one of said deflection signal generators, and (c) means coupling said astigmatism correction signal to said first screen grid electrode, said signal processing means comprising a correction signal generator to which the output of said one of said deflection signal generator is coupled, and a phase inverter and attenuator to which the output of said correction signal generator is coupled, and wherein the output of said correction signal generator is also coupled to said first screen grid electrode and the output of said phase inverter and attenuator is coupled to said control grid electrode.

8. A cathode ray tube system comprising a cathodoluminescent screen, an electron gun for projecting an electron beam onto said screen, magnetic field-forming yoke means for scanning said beam horizontally and vertically over said screen to produce a raster thereon, and power supply means for energizing said screen, gun and yoke;

said electron gun comprising in the order named a cathode, a control grid electrode, first and second screen grid electrodes, and first and second lens electrodes between which a main beam focusing lens field is established;

said first screen grid electrode having an aperture therein whose cross-sectional shape is elongated in the direction of said horizontal scan, and said second screen grid electrode having a circular aperture therein, said power supply means comprising:

(a) horizontal and vertical deflection signal generators for supplying appropriate scanning signals to said yoke, (b) signal processing means connected to one of said deflection signal generators for producing an astigmatism correction signal synchronized with the scan signal from said one of said deflection signal generators, and (c) means coupling said astigmatism correction signal to said first screen grid electrode, said signal processing means comprising first and second correction signal generators to which the outputs of said horizontal and vertical deflection signal generators are respectively coupled, a mixer to which the outputs of said correction signal generators are coupled, and a phase inverter and attenuator to which the output of said mixer is coupled, and wherein the output of said mixer is also coupled to said first screen grid electrode and the output of said phase inverter and attenuator is coupled to said control grid electrode.

* * * * *